US010148041B2

(12) United States Patent
Lyon et al.

(10) Patent No.: US 10,148,041 B2
(45) Date of Patent: Dec. 4, 2018

(54) SHIELDED ELECTRICAL COMPONENT HAVING GROUNDING FEATURES

(71) Applicant: TE CONNECTIVITY CORPORATION, Berwyn, PA (US)

(72) Inventors: Zachary Wood Lyon, Lewisville, NC (US); David James Rhein, Memphis, MI (US); Jeremy Christian Patterson, Winston-Salem, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/661,773

(22) Filed: Jul. 27, 2017

(65) Prior Publication Data

US 2018/0034214 A1 Feb. 1, 2018

Related U.S. Application Data

(60) Provisional application No. 62/369,468, filed on Aug. 1, 2016.

(51) Int. Cl.
*H01R 13/6591* (2011.01)
*H01R 4/2416* (2018.01)
(Continued)

(52) U.S. Cl.
CPC ..... *H01R 13/6591* (2013.01); *H01R 4/2416* (2013.01); *H01R 4/26* (2013.01);
(Continued)

(58) Field of Classification Search
CPC . H01R 4/64; H01R 4/26; H01R 4/646; H01R 11/12; H01R 4/2425; H01R 4/245;
(Continued)

(56) References Cited

U.S. PATENT DOCUMENTS 3,588,787 A * 6/1971 Collin ..... H01R 4/24 411/531
4,624,522 A * 11/1986 Greenwood ..... H01R 12/67 439/411
(Continued)

FOREIGN PATENT DOCUMENTS

JP 2015103282 A 6/2015
JP 2016006732 A 1/2016
WO 2015079988 A1 6/2015

OTHER PUBLICATIONS

International Search Report, International Application No. PCT/IB2017/054633, International Filing Date Jul. 28, 2017.

*Primary Examiner* — Truc Nguyen

(57) ABSTRACT

An electrical component includes a housing having a mounting end configured to be mounted to a structure and an electrical shield held by the housing and providing electrical shielding. The electrical shield is configured to be electrically grounded to the structure. The electrical shield has a mounting tab having a mounting area including an opening therethrough and a grounding feature in the mounting area near the opening. The grounding feature is configured to cut through a coated surface of the structure to directly engage a conductive layer of the structure to electrically connect the electrical shield to the structure through the coated surface.

20 Claims, 3 Drawing Sheets

(51) Int. Cl.

| | |
|---|---|
| ***H01R 13/629*** | (2006.01) |
| ***H01R 4/26*** | (2006.01) |
| ***H01R 4/64*** | (2006.01) |
| ***H01R 13/648*** | (2006.01) |
| *H01R 4/30* | (2006.01) |
| *H01R 4/38* | (2006.01) |

(52) U.S. Cl.
CPC ..... *H01R 4/64* (2013.01); *H01R 13/62938* (2013.01); *H01R 13/648* (2013.01); *H01R 4/304* (2013.01); *H01R 4/38* (2013.01); *H01R 2201/26* (2013.01)

(58) Field of Classification Search
CPC ..... H01R 4/2495; H01R 9/0512; H01R 13/6599; H01R 2201/20; H01R 4/2404; H01R 4/36; H01R 13/7195; H01R 31/02; H01R 43/20
See application file for complete search history.

(56) References Cited

U.S. PATENT DOCUMENTS

| | | | | |
|---|---|---|---|---|
| 4,780,096 | A * | 10/1988 | Franks, Jr. ..... | H01R 4/643 439/799 |
| 5,888,104 | A * | 3/1999 | Mello ..... | E04F 15/024 439/100 |
| 6,552,645 | B2 * | 4/2003 | Kuczynski ..... | H01H 37/5418 337/111 |
| 7,753,732 | B2 * | 7/2010 | Kameyama ..... | H01R 13/65802 439/607.27 |
| 8,262,413 | B2 * | 9/2012 | Fujiwara ..... | H01R 13/6596 439/607.28 |
| 8,597,051 | B2 * | 12/2013 | Yang ..... | H01R 12/57 439/589 |
| 2012/0190238 | A1 | 7/2012 | Omae | |
| 2014/0154908 | A1 * | 6/2014 | Magno ..... | H01R 4/48 439/345 |

* cited by examiner

SHIELDED ELECTRICAL COMPONENT HAVING GROUNDING FEATURES

CROSS-REFERENCE TO RELATED APPLICATIONS

This application claims the benefit of U.S. Provisional Application No. 62/369,468, filed Aug. 1, 2016, titled "SHIELDED ELECTRICAL COMPONENT HAVING GROUNDING FEATURES", the subject matter of which is herein incorporated by reference in its entirety.

BACKGROUND OF THE INVENTION

The subject matter herein relates generally to shielded electrical components having grounding features.

Many known electrical components provide shielding. For example, electrical connectors, such as power connectors, may include electrical shields used to electrically common with other electrical connectors or other grounded components. Some known connectors that use electrical shields are power connectors, such as those used to make a power connection between components in high power applications, such as in electric or hybrid electric vehicles between the battery and other components, such as the electric motor, the inverter, the charger, and the like.

It is generally desirable to have the electrical shields grounded. For example, the electrical connector may be mounted to a structure, such as a chassis or other main supporting structure that is conductive. The electrical shield may be electrically connected to the conductive structure. However, in some applications, such as automotive applications, the structure to which the electrical connector is mounted is coated or painted with a coating layer over the conductive layer. For example, the structure may be e-coated. The coating layer is typically non-conductive or significantly less conductive than the conductive layer, and thus is unsuitable for electrical connection with the shield of the electrical connector. It is difficult to provide sufficient electrical connection between the electrical shield of the connector and the coated structure.

A need remains for a connector system having components for electrically commoning an electrical shield of a component to a coated conductive structure.

BRIEF DESCRIPTION OF THE INVENTION

In one embodiment, an electrical component is provided including a housing having a mounting end configured to be mounted to a structure and an electrical shield held by the housing and providing electrical shielding. The electrical shield is configured to be electrically grounded to the structure. The electrical shield has a mounting tab having a mounting area including an opening therethrough and a grounding feature in the mounting area near the opening. The grounding feature is configured to cut through a coated surface of the structure to directly engage a conductive layer of the structure to electrically connect the electrical shield to the structure through the coated surface.

In another embodiment, an electrical connector is provided including a housing having a mounting end configured to be mounted to a structure and holding a terminal configured to be electrically connected to a mating terminal of a mating connector. An electrical shield is held by the housing. The electrical shield is configured to be electrically grounded to the structure and provides electrical shielding for the terminal. The electrical shield has a mounting tab having a mounting area including an opening therethrough. The mounting tab has a grounding feature in the mounting area near the opening. The grounding feature has a cutting edge configured to cut through a coated surface of the structure to directly engage a conductive layer of the structure to electrically connect the electrical shield to the structure through the coated surface.

In a further embodiment, an electrical connector is provided including a housing having a mounting end configured to be mounted to a structure and holding a terminal configured to be electrically connected to a mating terminal of a mating connector. An electrical shield is held by the housing and is configured to be electrically grounded to the structure. The electrical shield provides electrical shielding for the terminal. The electrical shield has a mounting tab having a mounting area including an opening therethrough. The mounting tab has a grounding feature in the mounting area near the opening. The grounding feature has a cutting edge configured to cut through a coated surface of the structure to directly engage a conductive layer of the structure to electrically connect the electrical shield to the structure through the coated surface. A fastener is received in the opening to mechanically secure the mounting tab to the structure. The fastener includes an axial loading member positioned above the mounting area inducing an axial loading force on the grounding feature to press the grounding feature against the structure.

DETAILED DESCRIPTION OF THE INVENTION

Figure 1:
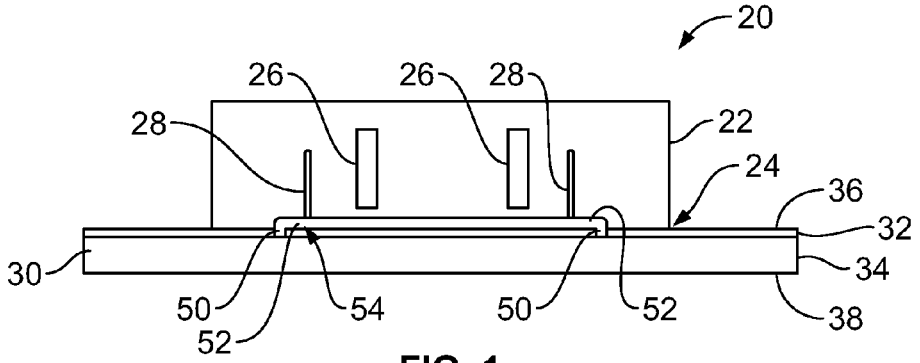
FIG. 1 is a schematic illustration of an electrical component electrically grounded to a structure utilizing grounding features in accordance with an exemplary embodiment.

FIG. 1 is a schematic illustration of an electrical component 20 electrically grounded to a structure 30. The structure 30 is conductive. For example, the structure 30 may be manufactured from a metal material. In an exemplary embodiment, the structure 30 is a coated structure wherein an outer layer of the structure 30 is a coated layer or coated surface 32 provided on a conductive layer 34 of the structure 30. For example, the coated surface 32 may be an electrodeposited e-coat on the conductive layer 34. The coated surface 32 may be painted on the conductive layer 34, such as through electro-painting or by other application processes. The coated surface 32 protects the structure 30 by covering the conductive layer 34. In an exemplary embodiment, the coated surface 32 is provided on a top 36 of the structure 30 and may additionally or alternatively be provided on a bottom 38 of the structure 30.

The electrical component 20 is mounted to the structure 30. The electrical component 20 may be any type of electrical component, such as an electrical connector. The electrical component 20 may include a housing 22 having a mounting end 24 configured to be mounted to the structure 30. Optionally, the electrical component 20 may hold one or more terminals 26 in the housing 22. The terminals 26 are configured to be electrically connected with another component, such as a mating connector (not shown).

In an exemplary embodiment the electrical component 20 includes an electrical shield 28 held by the housing 22 and providing electrical shielding for the electrical component 20, such as for the one or more terminals 26. The electrical shield 28 is configured to be electrically grounded to the structure 30. In an exemplary embodiment, the electrical shield 28 includes one or more grounding features 50 configured to be electrically connected to the conductive layer 34 of the structure 30 to electrically connect the shield 28 to the structure 30 through the coated surface 32. In an exemplary embodiment, the grounding features 50 cut or pierce through the coated layer 32 to directly engage the conductive layer 34 of the structure 30.

Optionally, the shield 28 may include one or more mounting tabs 52 each having a mounting area 54 configured to be mounted to the structure 30. The grounding features 50 may extend from the mounting tabs 52 in the mounting area 54. In an exemplary embodiment, when the electrical component 20 is mounted to the structure 30, the grounding features 50 may be pressed into the structure 30 and cut through the coated surface 32 to directly engage the conductive layer 34 to electrically connect the shield 28 to the structure 30 through the coated surface 32.

Figure 2:
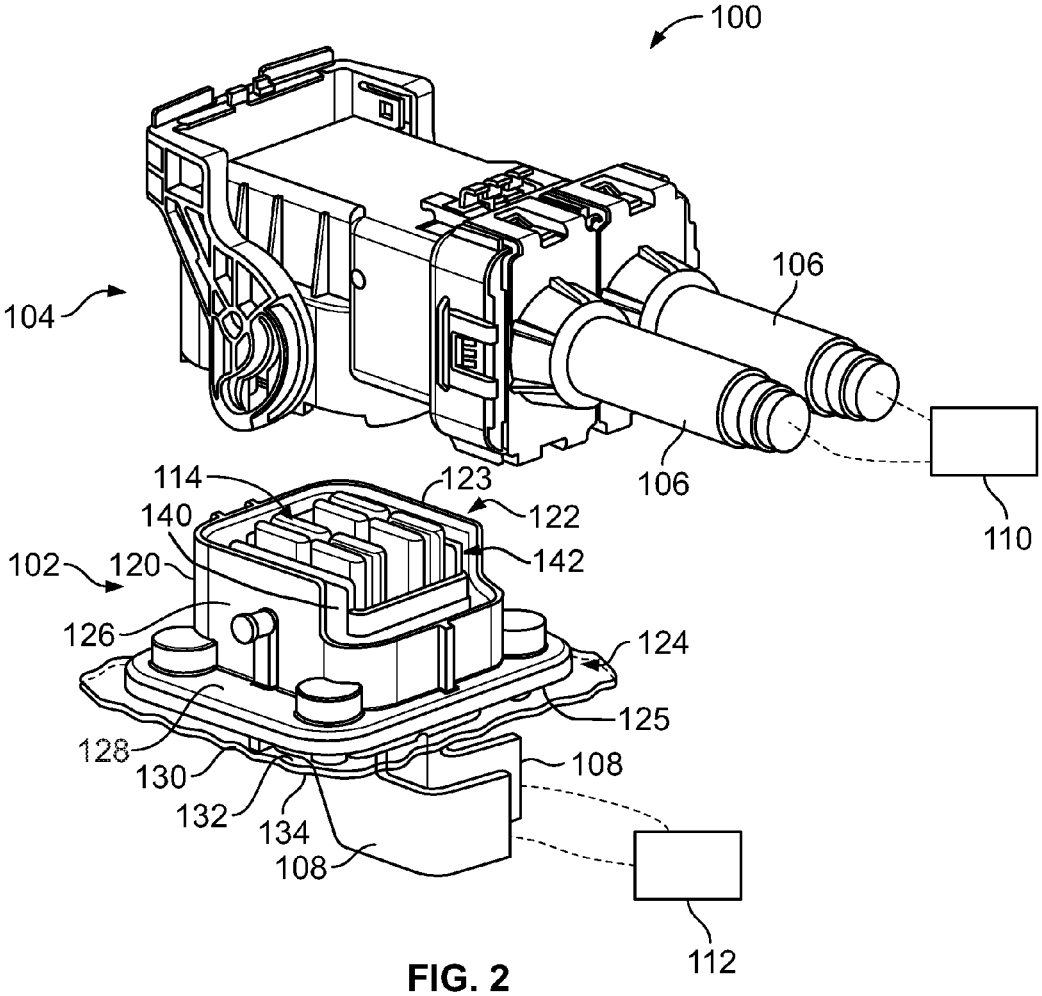
FIG. 2 is a perspective view of a system utilizing grounding features in accordance with an exemplary embodiment to electrically connect an electrical component to a structure.

FIG. 2 is a perspective view of a power connector system 100 utilizing grounding features in accordance with an exemplary embodiment. The power connector system 100 is an exemplary system utilizing the grounding features and the subject matter herein is not intended to be limited to use with the illustrated power connector system 100.

The power connector system 100 includes a header connector 102 and a plug connector 104 configured to be mated with the header connector 102. The plug connector 104 is shown poised for mating with the header connector 102. In an exemplary embodiment, the power connector system 100 is a high power connector system that is used to transfer power between various components as part of a high power circuit. In a particular application, the power connector system 100 is a battery system, such as a battery system of a vehicle, such as an electric vehicle or hybrid electric vehicle; however the power connector system 100 is not intended to be limited to such battery systems.

The plug connector 104 is configured to be electrically connected to a component 110, such as through one or more power cables 106. For example, the plug connector 104 may be electrically connected to a battery, a charger, an inverter, an electric motor or another type of component. The header connector 102 is configured to be electrically connected to a component 112, such as through a power bus 108; however the header connector 102 may be electrically connected to the component 112 by other means, such as a terminal, power wire or other connector. For example, the header connector 102 may be electrically connected to a battery pack, such as through a battery distribution unit, a manual service disconnect, a charger, an inverter, an electric motor, or another type of component. The battery distribution unit may manage the power capacity and functionality of the power connector system 100, such as by measuring current and regulating power distribution of the battery pack.

The power connector system 100 is a right angle connector system where the connectors 102, 104 are mated in a direction perpendicular to the power wires. Optionally, the plug connector 104 may be removably coupled to the header connector 102 to disconnect the high power circuit of one or more of the components, such as the battery pack, the electric motor, the inverter, or other components of the vehicle, such as for maintenance, repair or for another reason. When mated, one or more header terminals 114 of the header connector 102 are mated with corresponding plug terminals (not shown) of the plug connector 104, such as at mating interfaces thereof.

The header connector 102 includes a header housing 120 having a mating end 122 at a top 123 of the header housing 120 and a mounting end 124 at a bottom 125 of the header housing 120. The header housing 120 includes shroud walls 126 extending to the top 123. The header housing 120 holds the header terminals 114. Optionally, the header terminals 114 may be fork terminals having sockets defined by spring beams on both sides of the sockets to mate with both sides of the plug terminal; however, other types of header terminals 114 may be used in alternative embodiments, such as blade terminals.

The header housing 120 includes a flange 128 at the mounting end 124 for mounting the header housing 120 to a structure 130, such as a chassis or other supporting structure. The flange 128 may be separate from the shroud walls 126 or may be integral with the shroud walls 126.

In an exemplary embodiment, the structure 130 is conductive. For example, the structure 130 may be manufactured from a metal material, such as steel. In an exemplary embodiment, the structure 130 is a coated structure wherein an outer layer of the structure 130 is a coated layer or coated surface 132 provided on a conductive layer 134 of the structure 130. For example, the coated surface 132 may be an electrodeposited e-coat on the conductive layer 134. The coated surface 132 may be painted on the conductive layer 134, such as through electro-painting or by other application processes. The coated surface 132 protects the structure 130 by covering the conductive layer 134. Optionally, the header housing 120 may be mounted horizontally; however, other orientations are possible in alternative embodiments. Fasteners may be used to mount the header housing 120 to the structure 130.

The header housing 120 includes an electrical shield 140 to provide electrical shielding for the header terminals 114. The shield 140 may be connected to the plug connector 104 to electrically common the header connector 102 and the plug connector 104. Optionally, the header connector 102 may be electrically grounded to the structure 130. For example, the shield 140 may be electrically connected to the structure 130. The shield 140 is configured to pierce or cut through the coated surface 132 to directly engage the conductive layer 134 to provide a reliable electrical connection with the structure 130. The shield 140 may extend along the flange 128 for connection to the structure 130.

The header housing 120 defines a header chamber 142 configured to receive a portion of the plug connector 104. For example, the header chamber 142 may be defined by walls of the header housing 120. The shield 140 may extend into the chamber 142 to provide electrical shielding for the header contacts 114 and/or for mating with the plug connector 104.

Figure 3:
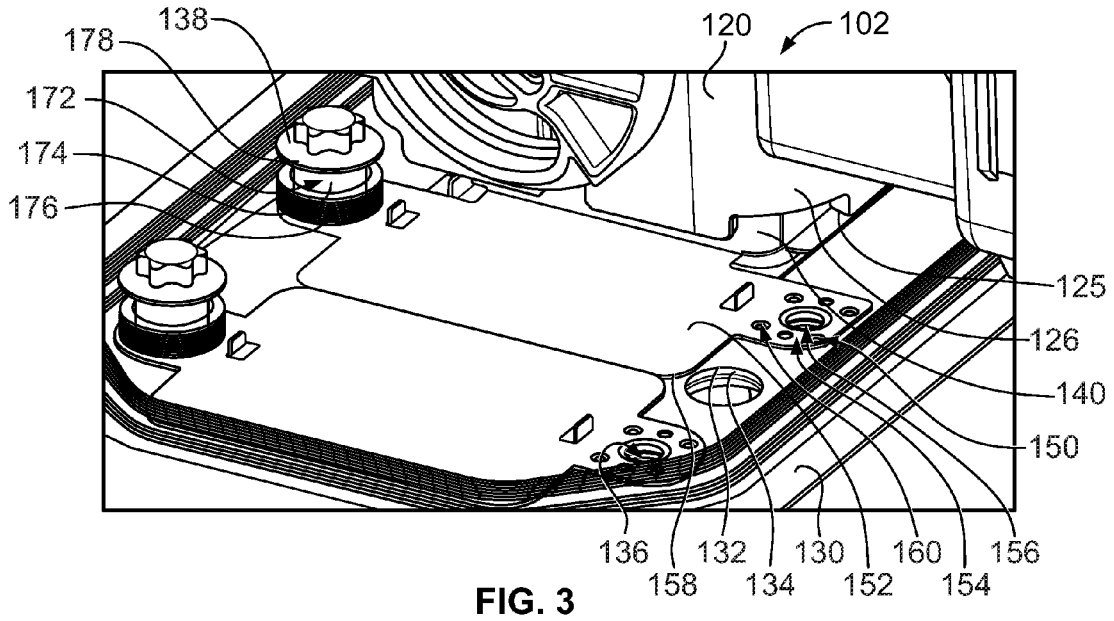
FIG. 3 is a perspective view of a portion of the electrical component mounted to the structure.
Figure 4:
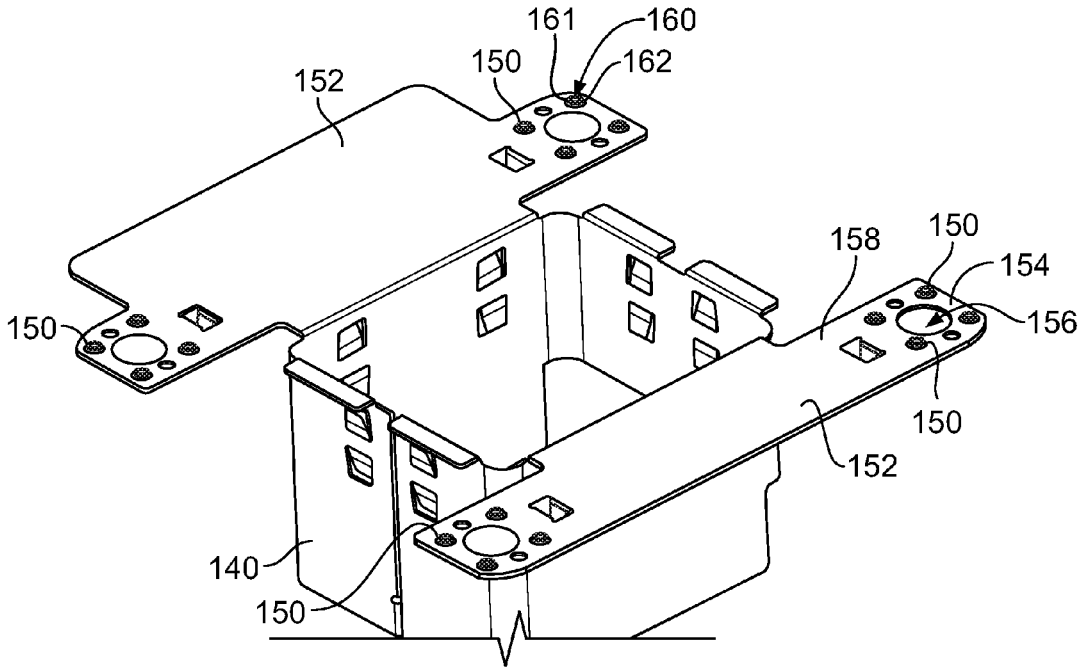
FIG. 4 is a bottom perspective view of an electrical shield of the electrical component in accordance with an exemplary embodiment.

FIG. 3 is a perspective view of a portion of the header connector 102 mounted to the structure 130. FIG. 3 illustrates the shroud walls 126, but the flange 128 (shown in FIG. 2) is removed to illustrate the connection between the shield 140 and the structure 130. As such, FIG. 3 shows portions of the shield 140 and the structure 130 that are under the flange 128 and not visible in FIG. 2. FIG. 4 is a bottom perspective view of the shield 140 in accordance with an exemplary embodiment. Features of the shield 140 are identified in both FIGS. 3 and 4, where appropriate, but features of the structure 130 are only shown in and identified in FIG. 3.

In an exemplary embodiment, the shield 140 extends to the bottom 125 of the header housing 120 for termination to the structure 130. The structure 130 includes openings 136 configured to receive fasteners 138 to secure the header connector 102 to the structure 130. The fasteners 138 may be threaded fasteners. When the fasteners 138 are secured to the structure 130, the header connector 102 is pulled tightly against the top of the structure 130.

In an exemplary embodiment, the shield 140 includes grounding features 150 configured to be electrically connected to the conductive layer 134 of the structure 130 to electrically connect the shield 140 to the structure 130 through the coated surface 132. For example, the grounding features 150 are configured to cut or pierce through the coated surface 132 to directly engage the conductive layer 134 to electrically connect the shield 140 to the structure 130 through the coated surface 132.

In an exemplary embodiment, the shield 140 includes one or more mounting tabs 152 at the bottom of the shield 140 extending along the top surface of the structure 132. The mounting tabs 152 are used to mount the shield 140 to the structure 130. Optionally, the mounting tabs 152 may be bent or folded from the shield walls of the shield 140 such that the mounting tabs 152 are generally horizontal along the structure 130.

Each mounting tab 152 includes one or more mounting areas 154 where the mounting tabs 152 are secured to the structure 130. Optionally, each mounting area 154 may include an opening 156 extending therethrough. The opening 156 is aligned with the corresponding opening 136 in the structure 130 to receive the fastener 138. The fasteners 138 may pass through the openings 156 to secure the header connector 102 to the structure 130.

Figure 6:
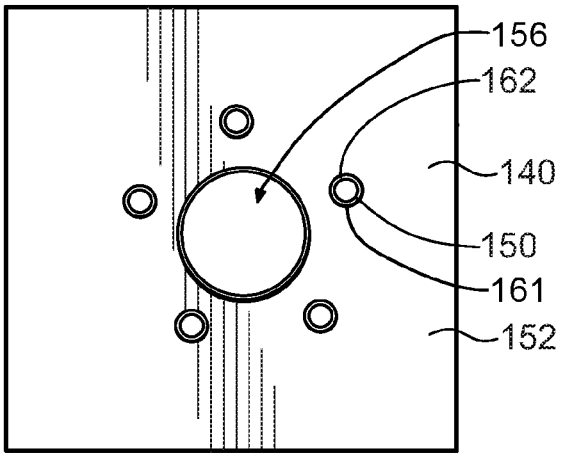
FIGS. 6 and 7 are enlarged views of portions of the electrical shield with FIG. 6 showing grounding features prior to use and FIG. 7 showing grounding features post use.
Figure 7:
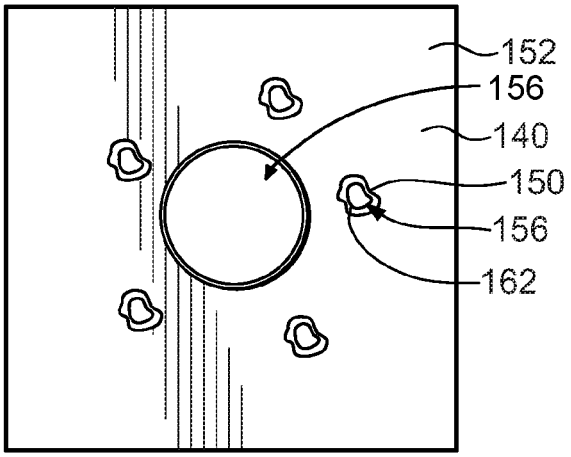

The grounding features 150 are positioned adjacent the corresponding openings 156. Optionally, a plurality of the grounding features 150 are provided in each mounting area 154 around the corresponding opening 156. The grounding features 150 may be positioned generally equidistant from each other around the openings 156. In the illustrated embodiment, four grounding features 150 are shown around the corresponding opening 156; however any number of grounding features 150 may be provided in alternative embodiments (for example, FIGS. 6 and 7 illustrate five grounding features 150). Using a plurality of grounding features 150 provides a greater number of contact points between the shield 140 and the conductive layer 134. Providing multiple grounding features 150 lowers the resistance between the shield 140 and the conductive layer 134. Providing multiple ground features 150 increases the chance of the shield 140 piercing the coated surface 132 to provide direct electrical connection between the shield 140 and the conductive layer 134 (for example, one or more of the grounding features 150 may fail to sufficiently pierce the coating surface 132, while other grounding features may sufficiently pierce the coating surface 132 to provide the electrical connection).

In an exemplary embodiment, the mounting tabs 152 are generally planar and each includes a bottom surface 158 facing the structure 130. The grounding features 150 may include a lip 161 that extends downward from the bottom surface 158 for engaging the structure 130. For example, the grounding features 150 may be formed by punching or stamping the mounting tabs 152 to form the grounding features 150, such that the lip 161 is integral to the mounting tab 152 and protrudes from the bottom surface 158. Optionally, the grounding features 150 may each include an opening 160 formed during the punching or stamping process to form the grounding features 150 out of the mounting tab 152. The opening 160 extends through the lip 161 of the grounding feature 150 and the mounting tab 152. The lip 161 surrounds the opening 160. The grounding features 150 may be formed under the bottom surface 158 during the manufacturing process to form a cutting edge 162 below the mounting tabs 152 configured to pierce the coated surface 132 of the structure 130. The cutting edge 162 may be located at the distal end of the lip 161, such that the lip 161 is integral to and defines the cutting edge 162.

When the header connector 102 is mounted to the structure 130 using the fasteners 138, the grounding features 150 are pressed into the structure 130. The grounding features 150 bite into the coated surface 132 and may displace part of the coated surface 132 to create metal-to-metal contact between the shield 140 and the conductive layer 134. The fasteners 138 provide a compressive load against the mounting tabs 152 and grounding features 150 to drive the grounding features 150 into the conductive layer 134.

In an exemplary embodiment, the fasteners 138 (FIG. 3) are configured to extend through the corresponding openings 156, 136. Each fastener 138 includes an axial loading member 172 configured to provide an axial loading force against the mounting tabs 152 and the grounding features 150 to press the grounding features 150 against the structure 130. In the illustrated embodiment, the axial loading member 172 is defined by a head 174 of the fastener 138. Optionally, the head 174 may pass at least partially through the flange 128 (shown in FIG. 2) to directly engage the mounting tabs 152 in the mounting area 154. As such, the head 174 may press directly against the shield 140 at the grounding features 150 to drive the grounding features 150 through the coated surface 132.

A seal 176 may be provided around the head 174 to provide sealing between the fastener 138 and the flange 128. The fastener 138 may include a disc 178 extending from the head 174 (for example, a stepped or double headed fastener) configured to engage the flange 128 (shown in FIG. 2) to press the flange 128 downward against the structure 130. In alternative embodiment, rather than the fastener 138 directly engaging the mounting tab 152, the fastener 138 may drive the flange 128 downward against the mounting tab 152 to provide an axial loading force on the grounding features 150.

Figure 5:
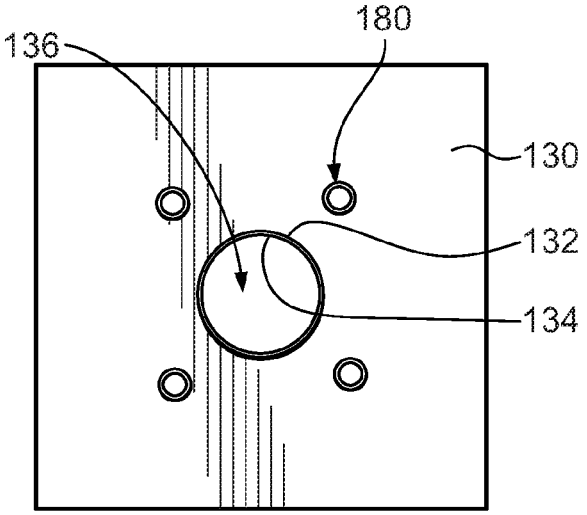
FIG. 5 is an enlarged view of a portion of the structure showing the effect of the electrical shield being coupled to the structure.

FIG. 5 is an enlarged view of a portion of the structure 130 showing the effect of the shield 140 coupled to the structure 130. Engagement areas 180 are illustrated in FIG. 5 where the grounding features 150 (shown in FIG. 4) have pierced the coated surface 132 to engage the conductive layer 134. Portions of the coated surface 132 have been displaced in the engagement areas 180 by the grounding features 150. For example, the grounding features 150 cut or pierce through the coated surface 132 around the opening 136 to expose the conductive layer 134 and directly engage the exposed portion of the conductive layer 134.

FIGS. 6 and 7 are enlarged views of a portion of the electrical shield 140 showing grounding features 150 surrounding an opening 156 in the mounting tab 152. FIG. 6 shows the grounding features 150 prior to use. FIG. 7 illustrates the grounding features 150 post use. The grounding features 150 are formed out of the mounting tab 152, such as by punching or stamping. When the metal material is folded under the mounting tab 152 to form the grounding features 150, the grounding features 150 may have a sharp edge. For example, the grounding features 150 may have the lip 161 that extends from the mounting tab 152 to a respective cutting edge 162 that is used to pierce the coated surface 132 of the structure 130. The grounding features 150 may have any size and shape and in the illustrated embodiment have a circular profile.

As shown in FIG. 7, after the grounding features 150 are pressed into the structure 130, the grounding features 150 are deformed. For example, the grounding features 150 are pressed or smashed against the structure 130 causing the cutting edges to be rolled under and deformed against the structure 130. As the cutting edge 162 is pressed, the cutting edge 162 wipes across the structure 130 biting into the coated surface 132 to expose a portion of the conductive layer 134 for direct metal-to-metal contact between the grounding features 150 and the conductive layer 134. A reliable electrical connection is made between the shield 140 and the conductive layer 134 of the structure 130.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical component comprising:

a housing having a mounting end configured to be mounted to a structure; and an electrical shield held by the housing and providing electrical shielding, the electrical shield being configured to be electrically grounded to the structure, the electrical shield having a mounting tab having a mounting area including an opening therethrough, the mounting tab having a grounding feature in the mounting area near the opening, the grounding feature including a grounding feature opening through the mounting tab and a lip extending entirely circumferentially around the grounding feature opening defining a cutting edge entirely around the grounding feature opening, the grounding feature configured to cut through a coated surface of the structure to directly engage a conductive layer of the structure to electrically connect the electrical shield to the structure through the coated surface.

2. The electrical component of claim 1, wherein the grounding feature includes a cutting edge configured to pierce the coated surface of the structure.

3. The electrical component of claim 1, wherein the grounding feature is punched from the mounting tab.

4. The electrical component of claim 1, wherein the mounting tab is punched through by a punching tool to remove a portion of the mounting tab forming the grounding feature opening and bending the metal to from the lip with a sharp edge defining the cutting edge configured to pierce the coated surface of the structure.

5. The electrical component of claim 1, wherein a plurality of grounding features are provided in the mounting area around the opening.

6. The electrical component of claim 5, wherein the grounding features are positioned generally equidistant from each other around the opening.

7. The electrical component of claim 1, wherein the mounting tab is planar having a bottom surface facing the structure, the grounding feature extending downward from the bottom surface for engaging the structure.

8. The electrical component of claim 1, further comprising a fastener received in the opening to mechanically secure the mounting tab to the structure, the fastener including an axial loading member positioned above the mounting area, the axial loading member inducing an axial loading force on the grounding feature to press the grounding feature against the structure.

9. An electrical connector comprising:

a housing having a mounting end configured to be mounted to a structure, the housing holding a terminal configured to be electrically connected to a mating terminal of a mating connector; and an electrical shield held by the housing, the electrical shield being configured to be electrically grounded to the structure, the electrical shield providing electrical shielding for the terminal, the electrical shield having a mounting tab having a mounting area including an opening therethrough, the mounting tab having a grounding feature in the mounting area near the opening, the mounting tab being punched through by a punching tool to remove a portion of the mounting tab forming a grounding feature opening in the grounding feature and bending the metal downward around the grounding feature opening defining a cutting edge configured to cut through a coated surface of the structure to directly engage a conductive layer of the structure to electrically connect the electrical shield to the structure through the coated surface.

10. The electrical connector of claim 9, wherein the grounding feature includes a cutting edge configured to pierce the coated surface of the structure.

11. The electrical connector of claim 9, wherein the cutting edge of the grounding feature is tubular having a hollow space defined by the grounding feature opening with the cutting edge entirely circumferentially surrounding the grounding feature opening.

12. The electrical connector of claim 9, wherein the grounding feature includes a lip extending entirely circumferentially around the grounding feature opening defining the cutting edge configured to pierce the coated surface of the structure.

13. The electrical connector of claim 9, wherein a plurality of grounding features are provided in the mounting area around the opening.

14. The electrical connector of claim 13, wherein the grounding features are positioned generally equidistant from each other around the opening.

15. The electrical connector of claim 9, wherein the mounting tab is planar having a bottom surface facing the structure, the grounding feature extending downward from the bottom surface for engaging the structure.

16. The electrical connector of claim 9, further comprising a fastener received in the opening to mechanically secure the mounting tab to the structure, the fastener including an axial loading member positioned above the mounting area, the axial loading member inducing an axial loading force on the grounding feature to press the grounding feature against the structure.

17. An electrical connector comprising:

a housing having a mounting end configured to be mounted to a structure, the housing holding a terminal configured to be electrically connected to a mating terminal of a mating connector;

an electrical shield held by the housing, the electrical shield being configured to be electrically grounded to the structure, the electrical shield providing electrical shielding for the terminal, the electrical shield having a mounting tab having a mounting area including an opening therethrough, the mounting tab having a grounding feature in the mounting area near the opening, the grounding feature having a grounding feature opening through the mounting tab and a lip extending entirely circumferentially around the grounding feature opening defining a cutting edge entirely around the grounding feature opening configured to cut through a coated surface of the structure to directly engage a conductive layer of the structure to electrically connect the electrical shield to the structure through the coated surface; and a fastener received in the opening to mechanically secure the mounting tab to the structure, the fastener including an axial loading member positioned above the mounting area, the axial loading member inducing an axial loading force on the grounding feature to press the grounding feature against the structure.

18. The electrical connector of claim 17, wherein a plurality of grounding features are provided in the mounting area around the opening.

19. The electrical connector of claim 17, wherein the mounting tab is planar having a bottom surface facing the structure, the grounding feature extending downward from the bottom surface for engaging the structure.

20. The electrical connector of claim 17, wherein the cutting edge of the grounding feature is tubular having a hollow space defined by the grounding feature opening with the cutting edge entirely circumferentially surrounding the grounding feature opening.

* * * * *